United States Patent [19]

Mundt et al.

[11] Patent Number: 4,576,303

[45] Date of Patent: Mar. 18, 1986

[54] RUPTURABLE PRESSURE RELIEVING FLUID CONTAINERS

[75] Inventors: Arnold L. Mundt; Charles E. Beair, both of Tulsa; Leo J. Naumann, Broken Arrow; Alan T. Roberts; Ronald J. LaPelle, both of Tulsa, all of Okla.

[73] Assignee: BS&B Safety Systems, Inc., Tulsa, Okla.

[21] Appl. No.: 703,867

[22] Filed: Feb. 21, 1985

[51] Int. Cl.[4] ..... F17B 1/14; B65D 51/16

[52] U.S. Cl. ..... 220/89 A; 137/68.1

[58] Field of Search ..... 220/89 A, 66; 137/68

[56] References Cited

U.S. PATENT DOCUMENTS

| | | | |
|---|---|---|---|
| 2,336,490 | 12/1943 | Lo Vico | 220/89 A |
| 2,380,964 | 8/1945 | Grover | 220/89 A |
| 2,553,267 | 5/1951 | Nedoh | 220/89 A |
| 3,039,482 | 6/1962 | Goldberg . | |
| 3,515,308 | 6/1970 | Hayes | 220/89 A |
| 3,815,534 | 6/1974 | Kneusel | 220/66 X |
| 3,834,580 | 9/1974 | Ludwig et al. . | |
| 4,059,858 | 11/1977 | Lambel | 137/68 R X |
| 4,207,913 | 6/1980 | Fike, Jr. . | |
| 4,404,982 | 9/1983 | Ou | 220/89 A X |
| 4,416,388 | 11/1983 | Mulawski | 220/89 A X |
| 4,513,874 | 4/1985 | Mulawski | 220/89 A |

FOREIGN PATENT DOCUMENTS 2336889 7/1973 Fed. Rep. of Germany .

OTHER PUBLICATIONS

"The Case for Lithium Batteries", Michael Brookman, appearing in Machine Design, Jul. 12, 1984.

*Primary Examiner*—Steven M. Pollard

*Attorney, Agent, or Firm*—C. Clark Dougherty, Jr.

[57] ABSTRACT

Pressure relieving fluid containers which provide a controlled rupture and pressurized fluid release when the pressure exerted on the container reaches a predetermined level. A substantially frustum-shaped indentation is included in a wall of the container and at least one score is formed on the part of the wall containing the indentation defining a rupture detachable blowout area. The frustum-shaped indentation is of a size with respect to the thickness of the wall containing it whereby when a predetermined fluid pressure is exerted on the wall, the indentation inverts and tears along the line of weakness created by the score thereby opening the portion of the wall corresponding to the blowout area and relieving fluid pressure therethrough.

22 Claims, 18 Drawing Figures

RUPTURABLE PRESSURE RELIEVING FLUID CONTAINERS

BACKGROUND OF THE INVENTION

1. Field of the Invention

The present invention relates generally to rutpurable pressure relieving fluid containers, and more particularly, but not by way of limitation, to fluid containers having rupturable pressure relief areas or members included therein.

2. Description of the Prior Art

A variety of rupturable pressure relieving fluid containers have been developed and used heretofore. For example, aerosol cans and battery cases have included rupturable pressure relief areas or vents which function to relieve excessive fluid pressure from within the cans and cases, such as when the cans or cases become overheated. Other rupturable pressure relief assemblies and devices which contain fluids under pressure until a predetermined high pressure level is exerted thereon have also been developed and used heretofore. For example, assemblies including one or more rupture disks are commonly utilized for over-pressure protection and operate to relieve pressurized fluid therethrough when the pressurized fluid contained thereby reaches a predetermined high or excessive level. The term "container" is used herein to broadly mean any apparatus, assembly or device which includes a fluid pressure rupturable portion or member, or which is capable of including an integral rupturable pressure relief area therein, e.g., rupture disks, rupture disk assemblies, aerosol and other cans for containing pressurized fluids, cases such as battery cases containing materials which can develop pressure upon overheating and other conditions, etc.

Most integral rupturable pressure relief areas heretofore included in containers have involved weakened areas which rupture upon reaching a predetermined pressure level. For example, German Pat. No. 2,336,889 dated Apr. 11, 1974 to Holl discloses a pressurized aerosol container having a concave bottom including a rupturable pressure relief area. That is, a weakened area having a wall thickness considerably thinner than the remainder of the bottom is included therein. The weakened area incorporates either a longitudinal recess or a circumferentially enclosed recess or a recess crossing the area in changing directions. In whatever form the recess takes, the weakened area ruptures and relieves pressurized fluids from the container when the pressure within the container reaches a high level. Such containers and other similar devices generally rupture at widely varying pressures and do not lend themselves to mass production.

A great variety of rupture disks and rupture disk assemblies have been developed and used heretofore for providing positive and controlled overpressure relief. An example of such a rupture disk assembly is described in U.S. Pat. No. 3,834,580 issued Sept. 10, 1984. The assembly includes a concave-convex reverse buckling rupture disk supported between inlet and outlet supporting members. The assembly contains pressurized fluids until a predetermined pressure level is reached whereupon the rupture disk reverses and ruptures to relieve pressure. The rupture disk includes a concave-convex portion having scores thereon creating lines of weakness therein.

The term "score" is used herein to mean an elongated narrow groove or indentation formed on a surface of a rupturable wall portion or disk whereby a corresponding line of weakness is created in the wall or disk. One or more scores can be utilized to form various patterns such as circles, arcs of circles, crosses, etc.

While concave-convex reverse buckling rupture disks have achieved great accuracy and high acceptance, they are susceptible to damage during production, handling or installation which can adversely affect their operation. In low pressure applications, extremely thin material is often required making the disks even more susceptible to damage.

By the present invention, improved rupturable pressure relieving fluid containers such as battery cases, aerosol cans, and rupture disk assemblies are provided which include rupturable frustum-shaped portions. Such rupturable containers allow the use of materials which are generally thicker for a given size and rupture pressure than heretofore possible, are less susceptible to damage, are mass produceable and achieve other advantages as will be apparent from the description which follows.

SUMMARY OF THE INVENTION

A rupturable pressure relieving fluid container apparatus comprising an enclosure forming the container which includes a wall of substantially uniform thickness, a frustum-shaped indentation in the wall which forms a recess therein exteriorly of the container and a corresponding protuberance interiorly thereof, and at least one score formed on the part of the wall containing the indentation defining a rupture detaching blowout area therein. The frustum-shaped indentation is of a size with respect to the thickness of the wall whereby when a predetermined fluid pressure is exerted from within the container on the wall, the indentation inverts and tears along the line of weakness created by the score thereby detaching a portion of the wall corresponding to the blowout area and relieving fluid pressure therethrough.

It is, therefore, a general object of the present invention to provide rupturable pressure relieving fluid containers.

A further object of the present invention is the provision of improved fluid containers having integral rupturable pressure relief areas formed therein.

Another object of the present invention is the provision of rupturable pressure relieving fluid containers which are less susceptible to inaccurate operation as a result of wall thickness variation or damage.

Other and further objects, features and advantages of the present invention will be readily apparent to those skilled in the art upon a reading of the description of preferred embodiments which follows when taken in conjunction with the accompany drawings.

BRIEF DESCRIPTION OF THE DRAWINGS

FIG. 13 is a bottom plan view of an alternate form of rupture disk of the present invention.

DESCRIPTION OF PREFERRED EMBODIMENTS

Figure 1:
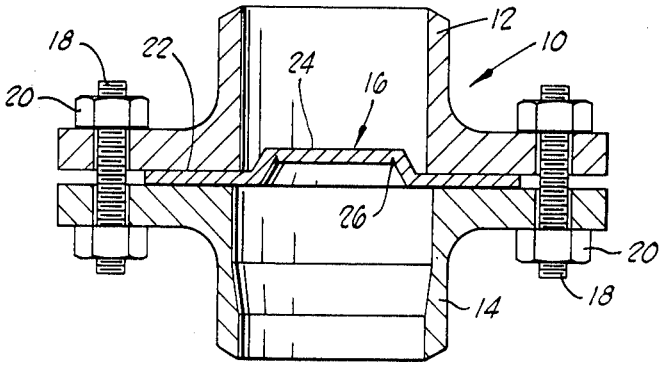
FIG. 1 is a side elevational cross-sectional view of a rupture disk assembly including the present invention.
Figure 2:
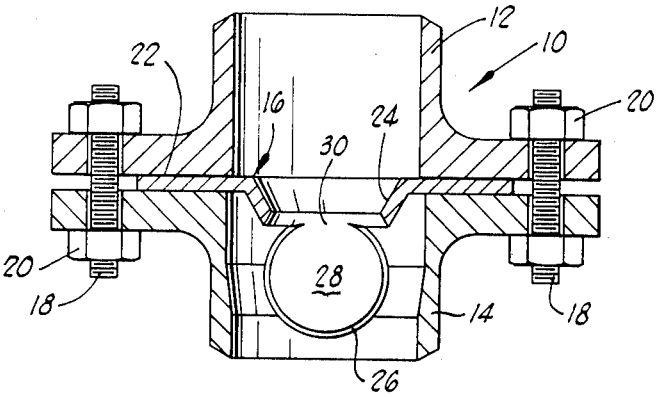
FIG. 2 is a view similar to FIG. 1 showing the rupture disk assembly after rupture has occurred.

Referring now to the drawings, and particularly to FIGS. 1 and 2, a rupturable pressure relieving fluid container of the present invention in the form of a rupture disk assembly, generally designated by the numeral 10, is illustrated. The rupture disk assembly 10 is comprised of inlet and outlet supporting members 12 and 14 with a rupture disk 16 clamped therebetween by means of a plurality of studs and nuts 18 and 20.

The rupture disk 16 will be described in greater detail hereinbelow, but basically includes an annular flange portion 22 connected to a centrally positioned substantially frustum-shaped portion 24. The convex side of the frustum portion 24 of the rupture disk 16 faces the inlet supporting member 12 whereby the force of the pressurized fluid contained therein is exerted on the convex side of the disk 16. An arcuate score 26 is formed in the top of the frustum portion of the rupture disk 16, preferably on the concave side thereof. The top of the frustum portion is preferably flat, but it can be moderately bulged in either direction. In the form illustrated in FIGS. 1 and 2, the score 26 is arcuate and defines a circular rupture detachable blowout area 28 (FIG. 2) in the disk 16 connected to the remainder of the disk by an unscored retaining hinge area 30.

When the pressure exerted on the rupture disk 16 by the fluid contained within the rupture disk assembly 10 reaches a predetermined level, the frustum portion 24 of the rupture disk snaps to an inverted position, i.e., the frustum portion 24 inverts itself instantaneously, causing the disk to tear along the line of weakness created by the score 26 and a portion of the disk corresponding to the blowout area 28 to detach as illustrated in FIG. 2 whereby pressurized fluid is relieved therethrough. The unscored hinge area 30 retains the blowout portion 28 attached to the remainder of the disk.

Figure 3:
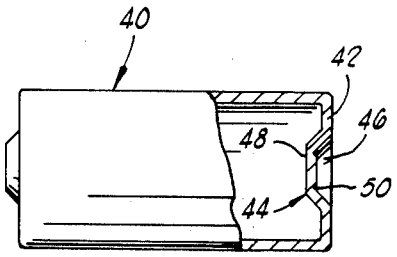
FIG. 3 is a side partially sectional view of a battery case of the present invention including an integral pressure relief area.
Figure 4:
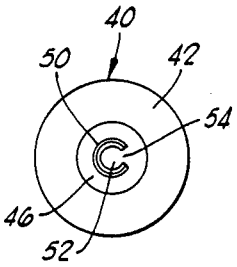
FIG. 4 is an end view of the battery case of FIG. 3.
Figure 5:
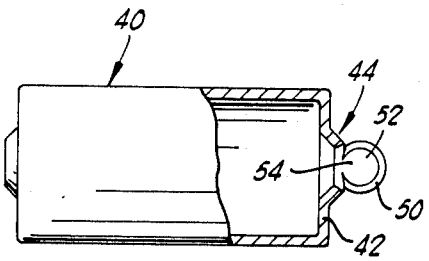
FIGS. 5 is a side partially sectional view of the battery case of FIGS. 3 and 4 after rupture has occurred.

Referring now to FIGS. 3, 4 and 5, an alternate form of pressure relieving fluid container is shown, i.e., a battery case generally designated by the numeral 40. The battery case 40 includes an end wall portion 42 of substantially uniform thickness which has a rupturable pressure relief area formed therein. The pressure relief area is comprised of a substantially frustum-shaped indentation 44 in the wall portion 42 which forms a substantially frustum-shaped recess 46 therein exteriorly of the case and a corresponding substantially frustum-shaped protuberance 48 interiorly of the case.

As best shown in FIG. 4, an arcuate score 50 is positioned in the portion of the wall 42 forming the top of the frustum-shaped indentation 44 within the recess 46 thereof. The score 50 defines a circular rupture detachable blowout area 52 connected to the remainder of the wall 42 by an unscored hinge area 54.

In operation of the rupturable pressure relieving battery case 40, when an overpressure condition exists within the case, the pressure exerted n the protuberance 48, i.e., the convex side of the indentation 44, causes the indentation to invert and rupture as illustrated in FIG. 5. That is, the wall 42 cracks or tears along the line of weakness created by the score 50 whereby a portion of the wall 42 corresponding to the blowout area 52 is detached and bent outwardly but is retained by the unscored hinge area 54.

Figure 6:
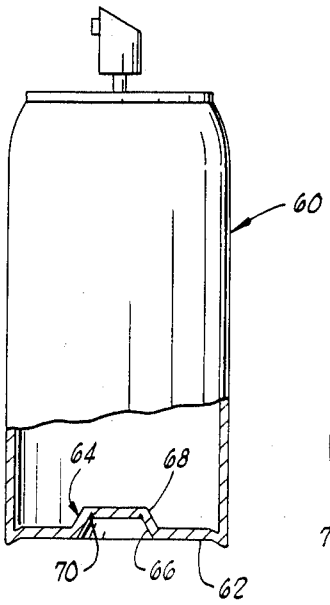
FIG. 6 is a side partially sectional view of an aerosol can of the present invention including an integral rupturable pressure relief area.
Figure 7:
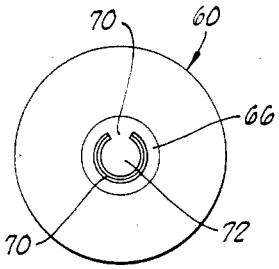
FIG. 7 is a bottom view of the aerosol can of FIG. 6.
Figure 8:
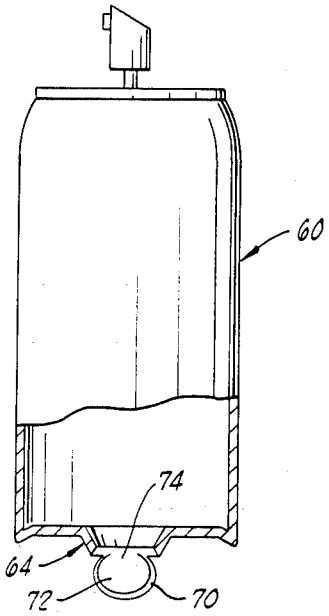
FIG. 8 is a side partially sectional view of the aerosol can of FIGS. 6 and 7 after rupture has occurred.
Figure 9:
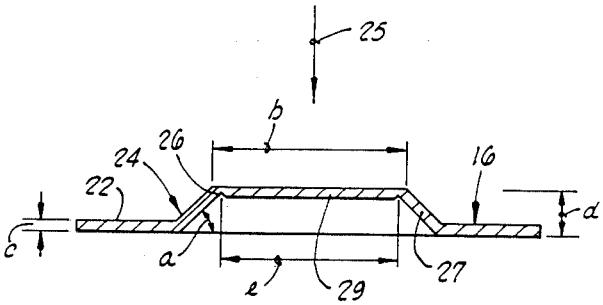
FIG. 9 is a side cross-sectional view of a rupture disk of the present invention.
Figure 10:
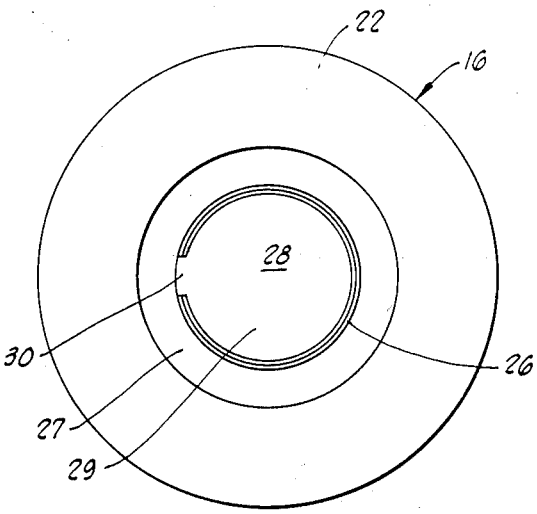
FIG. 10 is a bottom plan view of the rupture disk of FIG. 9.

Referring now to FIGS. 6, 7 and 8, an alternate pressure relieving fluid container in the form of an aerosol can is illustrated and generally designated by the numeral 60. The bottom wall 62 of the can 60 is of substantially uniform thickness and includes a substantially frustum-shaped indentation 64 therein which forms an exterior frustum-shaped recess 66 and a corresponding interior frustum-shaped protuberance 68. An arcuate score 70 is formed in the part of the wall 62 forming the top of the frustum-shaped indentation 64 defining a circular rupture detachable blowout area 72 therein.

The operation of the pressure relieving aerosol can 60 is the same as the rupture disk assembly 10 and the battery case 40 described above, i.e., when an overpressure condition exists within the can 60, the frustum-shaped indentation 64 inverts and ruptures whereby the part of the wall corresponding to the blowout area 72 detaches and is bent outwardly to relieve pressurized fluids therethrough. An unscored hinge area 74 retains the wall part 72 connected to the remainder of the wall 62.

The rupturable pressure relieving fluid containers of the present invention can take a variety of forms other than the rupture disk assembly 10, battery case 40 and aerosol can 60 described above. That is, the present invention can be applied to any rupture disk assembly or container wherein fluid pressure is or may be contained. In addition, a variety of score configurations and numbers of scores can be utilized. For example, straight line intersecting scores can be formed on the top or the top and sides of the frustum-shaped portion or indentation of a rupture disk or container whereby petals or sections are formed upon rupture.

The substantially frustum-shaped rupturable area and score configuration described above in connection with the rupture disk assembly 10, battery case 40 and aerosol can 60, i.e., a frustum-shaped portion of a disk or wall including a single arcuate score defining a circular rupture detachable blowout area is illustrated in a rupture disk in FIGS. 9–12. Other alternate rupture disks including frustum-shaped portions of the present invention including alternate score configurations and arrangements are illustrated in FIGS. 13–18. While these various embodiments of the present invention are shown in rupture disks, it is to be understood that they are equally applicable to any of the various rupturable pressure relieving fluid containers described herein and as stated above, score configurations other than arcuate scores can be utilized.

Referring specifically to FIGS. 9–12, the rupture disk 16 of the rupture disk assembly 10 is illustrated in detail. The rupture disk 16 includes a frustum-shaped, preferably a frusto-conical, central portion 24 connected to an annular flat flange portion 22. As indicated above, fluid pressure is exerted in the direction of the arrow 25 on the convex side of the disk 16 and an arcuate score 26 is disposed in the top 29 of the frusto-conical portion 24 on the concave side of the disk 16. The score 26 is preferably positioned substantially coincident with the intersection of the sides 27 of the frusto-conical portion 24 with the top 29 thereof. As described above, the arcuate score 26 creates a line of weakness in the disk 16 and defines a rupture detachable blowout area 28 connected by an unscored retaining hinge area 30 to the remainder of the disk.

The particular size and shape of the frusto-conical portion 24 of the disk 16 as well as the thickness of the material forming the disk determines the pressure at which the frusto-conical portion inverts and ruptures. More particularly and referring to FIG. 9, the variables determining the pressure at which the frusto-conical portion 24 inverts and ruptures are the thickness "c" of the disk, the diameter "b" of the top 29 of the frusto-conical portion 24, the diameter "e" of the arcuate score 26 and the height "d" of the frusto-conical portion 24. The angle "a" at which the sides of the frusto-conical portion are inclined also influences the pressure at which the frusto-conical portion inverts. These variables are determined by trial and error prior to manufacturing a group of rupture disks or other containers of the present invention. Generally, however, the angle "a" of the sides of the frusto-conical portion is in the range of from about 10° to about 75° and the ratio of the diameter "b" of the top of the frusto-conical portion to the height "d" thereof is in the range of from about 5 to about 20.

Figure 11:
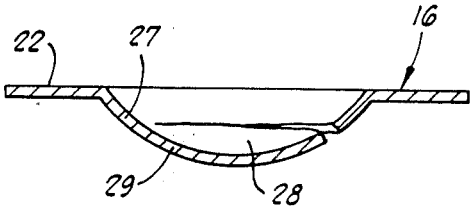
FIG. 11 is a side cross-sectional view of the rupture disk of FIGS. 9 and 10 after inversion and rupture.
Figure 12:
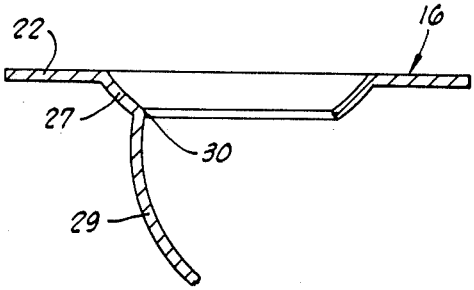
FIG. 12 is a side cross-sectional view of the rupture disk of FIGS. 9, 10 and 11 after the full opening thereof.

In operation of the frusto-conical portion 24, when the fluid pressure exerted thereon reaches the pressure at which the disk is designed to rupture, the frusto-conical portion 24 inverts and as shown in FIG. 11, the material forming the disk tears away from the sides of the frusto-conical portion at the score 26 whereby a portion of the disk corresponding to the blowout area 28 detaches. The sides 27 of the frusto-conical portion 24 function in the manner of a Belleville spring in that when the force exerted thereon reaches a certain level, the sides 27 instantaneously invert which forces the top 29 to deflect as it moves through the sides and the disk material to crack or tear along the line of weakness created by the score 26 as illustrated in FIG. 11. After the initial inversion and rupture, if the pressurized fluids flowing through the ruptured disk are appreciable, the detached portion of the disk corresponding to the blowout area 28 is moved to a fully opened position as shown in FIG. 12, but it is retained by the unscored hinge area 30.

Figure 14:
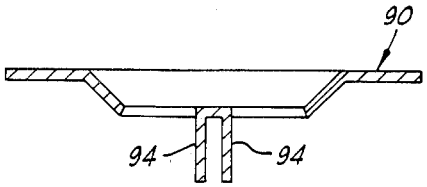
FIG. 14 is a side cross-sectional view of the rupture disk of FIG. 13 after the inversion, rupture and full opening thereof.
Figure 19:
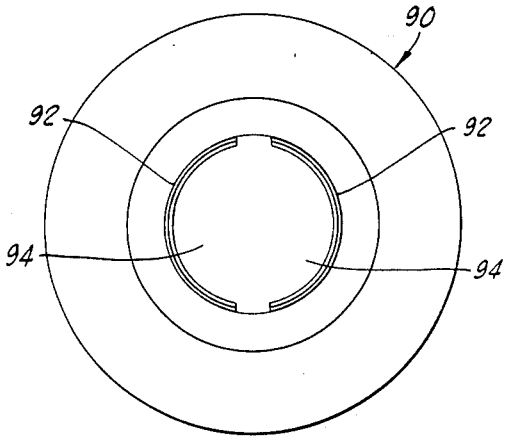
Figure 15:
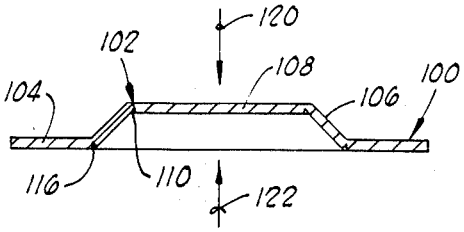
FIG. 15 is a side cross-sectional view of another alternate form of rupture disk of the present invention.
Figure 16:
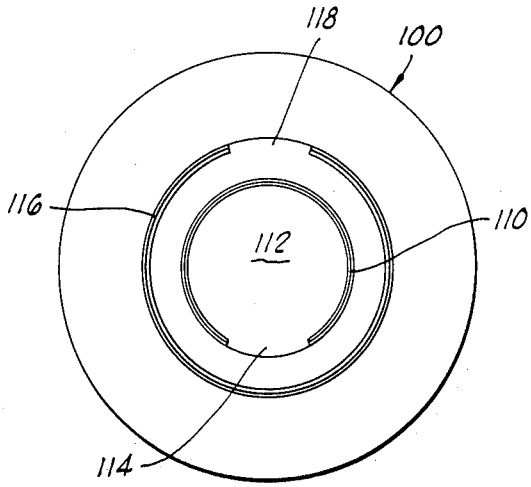
FIG. 16 is a bottom plan view of the rupture disk of FIG. 15.

Referring now to FIGS. 13 and 14, an alternate embodiment of the present invention is illustrated and generally designated by the numeral 90. The disk 90 is identical to the disk 16 except that two arcuate scores 92 are formed on the disk defining two rupture detachable blowout portions 94 therein as shown in FIG. 13. In operation, when the frusto-conical portion inverts and the disk ruptures, parts of the disk corresponding to the areas 94 are folded downwardly around a central hinge as shown in FIG. 14. Referring to FIGS. 15–18, another alternate embodiment of the present invention is illustrated and generally designated by the numeral 100. The apparatus 100 includes a frusto-conical portion 102 attached to an annular flat flange portion 104. The frusto-conical portion 102 includes sides 106 connected to a top 108 and an arcuate score 110 is formed in the top 108. As best shown in FIG. 16, the arcuate score 110 defines a rupture detachable blowout area 112 connected to the remainder of the disk by an unscored hinge area 114. In addition, the apparatus 110 includes a second arcuate score 116 positioned on the concave side of the disk 100 at the intersection of the sides 106 of the frusto-conical portion with the annular flat flange portion 104. The score 116 circumscribes the frusto-conical portion 102 except for an unscored hinge area 118.

Figure 17:
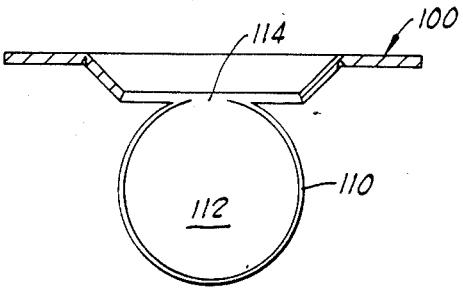
FIG. 17 is a side cross-sectional view of the rupture disk of FIGS. 15 and 16 after the inversion, rupture and full opening thereof in one direction.
Figure 18:
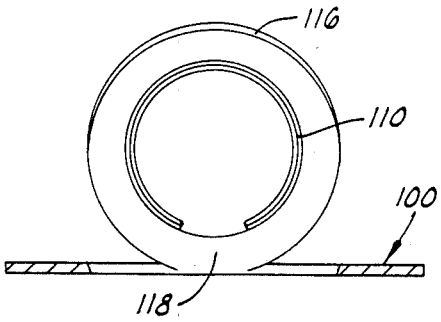
FIG. 18 is a side cross-sectional view of the rupture disk of FIGS. 15 and 16 after rupture and full opening in another direction.

The disk 100 is utilized in applications where fluid pressure can be exerted on either side of the disk. When a predetermined fluid pressure is exerted on the disk 100 in a direction indicated by the arrow 120 on FIG. 15, the frusto-conical portion 102 inverts and the disk ruptures and opens as shown in FIG. 17 in the same manner as described above for the disk 16. When a predetermined fluid pressure is exerted on the disk 100 from the opposte side thereof, i.e., in the direction indicated by the arrow 122 of FIG. 15, the disk fails at the score 116 and the entire frusto-conical portion 102 is moved upwardly but is retained by the hinge area 118 as shown in FIG. 18.

Thus, the present invention is well adapted to carry out the objects and attain the ends and advantages mentioned as well as those inherent therein. While presently preferred embodiments of the invention have been described for purposes of this disclosure, numerous changes in the number and configuration of scores and in other aspects of the rupturable pressure relieving fluid container apparatus of this invention will suggest themselves to those in the art. Such changes are encompassed within the spirit of this invention as defined by the appended claims.

What is claimed is:

1. A rupturable pressure relieving fluid container apparatus comprising:

an enclosure forming said container which includes a wall of substantially uniform thickness;

a substantially frustum-shaped indentation in said wall which forms a recess therein exteriorly of said container and a corresponding protuberance interiorly of said container;

at least one score formed on the indented part of said wall defining a rupture detachable blowout area; and said frustum-shaped indentation being of a size with respect to the thickness of said wall whereby when a predetermined fluid pressure is exerted from within said container on said wall, said indentation inverts and tears along the line of weakness created by said score thereby detaching a wall portion corresponding to said blowout area and relieving fluid pressure therethrough.

2. The apparatus of claim 1 wherein said fluid container is a battery case.

3. The apparatus of claim 1 wherein said fluid container is an aerosol can.

4. The apparatus of claim 1 wherein said fluid container is a rupture disk assembly and said wall is a rupture disk.

5. The apparatus of claim 1 wherein said score is arcuated and defines a round rupture detachable blowout area connected to the remainder of said wall by an unscored hinge area.

6. The apparatus of claim 1 wherein said indentation has a frusto-conical shape and said score is positioned in the surface of said wall forming the top thereof.

7. The apparatus of claim 6 wherein said score defines a circular rupture detachable blowout area connected to the remainder of said wall by an unscored retaining hinge area.

8. The apparatus of claim 7 wherein said score is positioned substantially coincident with the intersection of the wall forming the top of said frusto-conical indentation with the wall forming the side thereof.

9. In a fluid container having an integral rupturable pressure relief area formed therein which ruptures and relieves pressurized fluids therethrough at a predetermined pressure level exerted thereon, the improvement comprising:

said container including a wall of substantially uniform thickness;

a substantially frustum-shaped indentation in said wall which forms a recess therein exteriorly of said container and a corresponding protuberance interiorly of said container;

one or more scores formed on the part of said wall containing said indentation which define one or more rupturable detachable blowout areas; and said frustum-shaped indentation being of a size with respect to the thickness of said wall whereby when a predetermined fluid pressure is exerted from within said container on said wall, said indentation inverts and tears along lines of weakness created by said scores thereby detaching wall portions corresponding to said one or more blowout areas and relieving fluid pressure therethrough.

10. The apparatus of claim 9 wherein said fluid container is a battery case.

11. The apparatus of claim 9 wherein said fluid container is an aerosol can.

12. The apparatus of claim 9 wherein said fluid container is a rupture disk assembly and said wall of substantially uniform thickness is a rupture disk contained in said assembly.

13. The apparatus of claim 9 which includes a single arcuate score defining a round rupture detachable blowout area connected to the remainder of said wall by an unscored hinge area.

14. The apparatus of claim 9 wherein said indentation has a frusto-conical shape and said one or more scores are positioned on a surface of said wall forming the top thereof.

15. The apparatus of claim 14 wherein said score defines a circular rupture detachable blowout area connected to the remainder of said wall by an unscored retaining hinge area.

16. The apparatus of claim 15 wherein said score is positioned substantially coincident with the intersection of the wall forming the top of said frusto-conical indentation with the wall forming the side thereof.

17. The apparatus of claim 16 wherein said score is formed on the exterior side of said wall.

18. In a rupture disk assembly for relieving pressurized fluids contained thereby when the pressure of the fluids reaches a predetermined level, the improvement comprising:

said rupture disk in said assembly including a frusto-conical portion positioned whereby the pressure of said fluids is exerted on the convex side thereof;

at least one score formed on said frusto-conical portion of said rupture disk defining a rupture detachable blowout area therein; and said frusto-conical portion being of a size with respect to the thickness of said disk whereby when a predetermined pressure is exerted on said frusto-conical portion, said portion inverts and tears along the line of weakness created by said score thereby detaching a portion of said rupture disk corresponding to said blowout area and relieving pressurized fluids therethrough.

19. The rupture disk assembly of claim 18 wherein said score defines a round blowout area connected to the remaining portion of said disk by an unscored hinge area.

20. The rupture disk assembly of claim 19 wherein said score is formed on the part of said rupture disk forming the top of said frusto-conical portion and defines a circular blowout area therein connected to the remaining portion of said disk by an unscored retaining hinge area.

21. The rupture disk assembly of claim 20 wherein said score is positioned substantially coincident with the intersection of the part of said disk forming the top of said frusto-conical portion with the part of said disk forming the side thereof.

22. The rupture disk assembly of claim 18 wherein two or more scores are formed on said rupture disk defining two or more rupturable detachable blowout areas therein.

* * * * *